United States Patent [19]

Hägel

[11] Patent Number: 4,570,459

[45] Date of Patent: Feb. 18, 1986

[54] COMPOUND NEEDLE FOR WARP KNITTING MACHINE

[75] Inventor: Adolf Hägel, Bad Steben, Fed. Rep. of Germany

[73] Assignee: Liba Maschinenfabrik GmbH, Naila, Fed. Rep. of Germany

[21] Appl. No.: 602,494

[22] Filed: Apr. 20, 1984

[30] Foreign Application Priority Data

Apr. 28, 1983 [DE] Fed. Rep. of Germany ..... 3315446

[51] Int. Cl.[4] ..... D04B 35/04

[52] U.S. Cl. ..... 66/120

[58] Field of Search ..... 66/120

[56] References Cited

U.S. PATENT DOCUMENTS

| | | | |
|---|---|---|---|
| 3,952,551 | 4/1976 | Kohl | 66/120 |
| 4,196,600 | 4/1980 | Kohl | 66/120 |
| 4,222,249 | 9/1980 | Winter | 66/120 |
| 4,363,224 | 12/1982 | Wunner | 66/120 |

FOREIGN PATENT DOCUMENTS

| | | | |
|---|---|---|---|
| 2732889 | 2/1979 | Fed. Rep. of Germany | 66/120 |
| 2069543 | 8/1981 | United Kingdom | 66/120 |

*Primary Examiner*—Ronald Feldbaum

*Attorney, Agent, or Firm*—Anthony A. O'Brien

[57] ABSTRACT

A compound needle for a warp knitting machine is disclosed comprising a needle stem having a hook (5) at one end and a breast portion (7) at the other. Between the two is a connecting portion (6) over which the warp threads (13) are laid. The needle stem has a longitudinal groove (8, 9) extending the length of the connecting portion (6) and into the breast portion (7). Slidably located in the groove (8, 9) is a slide memeber (3) having a forwardly extending hook closure member (4) which, in the rearward position of the slide is completely concealed by the breast portion (7). As the slide (3) is pushed along the groove (8, 9) by the operating arm (2) the hook closure member (4) collects the warp threads (13) and transports them into the hook (5) before finally closing the hook (5) prior to withdrawal of the hook (5) through the loop (15) to complete the stitch.

3 Claims, 6 Drawing Figures

COMPOUND NEEDLE FOR WARP KNITTING MACHINE

FIELD OF INVENTION

The invention relates to compound needles for warp knitting machines.

BACKGROUND AND PRIOR ART

Compounds needles for warp knitting machines are known to include a needle stem having a hook at one end, and provided with a longitudinal groove in which is accommodated a slide carrying a closure cover member which in a closed position of the slide covers the end of the hook and which in an open position is concealed within in the groove behind a breast portion of the needle.

A compound needle of this type is disclosed in German patent Specification No. 1 760 140 (P 19 02). That compound needle involves the respective loop being carried by the needle stem until the slide has closed the opening of the hook. In order to ensure that that happens, the compound needle is of such a design that the transition between the closure member and the slide arm (which is referred to as the bend point) remains in the groove in the stem of the needle in every position in respect of the relative movement of the stem of the needle and the slide. That design gives rise to difficulties, particularly when there is a large number of yarns, for example six yarns, to be laid into the opening of the hook. In that case the hook opening must be of substantial length which in turn requires a correspondingly long closure member on the slide. That results in an undesirable reduction in the rigidity of the closure member and means also that, upon movement of the slide along the needle, the tip of the closure member can strike against the end of the hook, with consequential damage to the closure member or the hook.

In order to avoid that difficulty, it is already known from German laid-open aplication (DE-OS) No. 30 05 787 (P 29 84) for the closure member to be shorter than the opening of the hook, so that when the opening of the hook is closed by the tip of the closure member, the bend point on the slide, i.e. the junction between the closure member and the operating arm, has come out of the groove. In that case the slide is of such a cross-section that it carries the respective loop without being supported on the needle stem and/or by the hook end. That permits an increase in the size of the opening of the hook into which a correspondingly large number of yarns can be laid. In that arrangement, the slide is of such a configuration that the operating arm of the slide is still located in the groove in the stem of the needle when the slide is in the closed position. The slide is thus still positively guided even in the closed position. In that case, however, the slide which is correspondingly increased in length by virtue of the greater length of the opening hook requires a correspondingly increased amount of space for longitudinal movement in the rearward direction. That involves a correspondingly long needle stem, as, in the open position, the slide must be completely accommodated in the groove. The increase in length of the hook opening is subject to certain limits, by virtue of the above-mentioned necessary increase in length of the stem of the needle in a rearward direction.

OBJECT OF THE INVENTION

The object of the invention is to provide a compound needle for a warp knitting machine which readily permits an increase in size of the space available for yarn laying but in which the slide remains short in length.

SUMMARY OF THE INVENTION

According to the invention, the above object is achieved in that disposed between the breast portion and the hook is a connecting portion which receives the laid yarn and which has a guide groove for the slide, which forms an extension to the groove in the breast portion of the needle, but of shallow depth, so that as the slide moves along the connecting portion the closure member projects out of the guide groove, thereby to collect the yarns laid over the connecting portion, and to transport the yarns over an inclined flattened end of the connecting portion into the hook.

The connecting portion of the needle thus provides a length over which a plurality of yarns may be laid; the length of the connection portion, and thus the number of yarns that can be accommodated, being limited only by the rigidity of the stem of the needle. In that respect, that has no influence on the length of the closure member, or the position of the bend point between the closure member and the slide arm. Moreover, the groove in the connecting portion always provides the slide with the necessary guidance, even if the slide has moved in front of the breast portion of the stem of the needle, so that there is no need for the stem of the needle to be extended rearwardly. The closure member which projects out of the guide groove and which extends over yarns which are laid on the connecting portion ensures that during the closure movement, the yarns are reliably collected in front of the closure member and transported thereby into the hook.

Desirably, the slide has a middle section, i.e. between the closure member and the operating arm, that is completely concealed within the groove in the connecting portion of the needle. That arrangement provides that, in the closure movement, when a loop carried by the stem of the needle moves into the region of the connecting portion, the loop does not load the slide but is carried instead wholly by the connecting portion. In that case, when the stem of the needle is retracted relative to the loop and the slide to such an extent that the closure member closes the end of the hook, the loop can readily slide off over the closure member and the hook. During this action any loading on the closure member is carried by virtue of the closure member bearing against the end of the hook or by the guide portion of the slide being supported on the bottom of the guide groove.

DESCRIPTION OF THE DRAWINGS

Embodiments of the invention are illustrated in the drawings in which.

DETAILED DESCRIPTION

Figure 1:
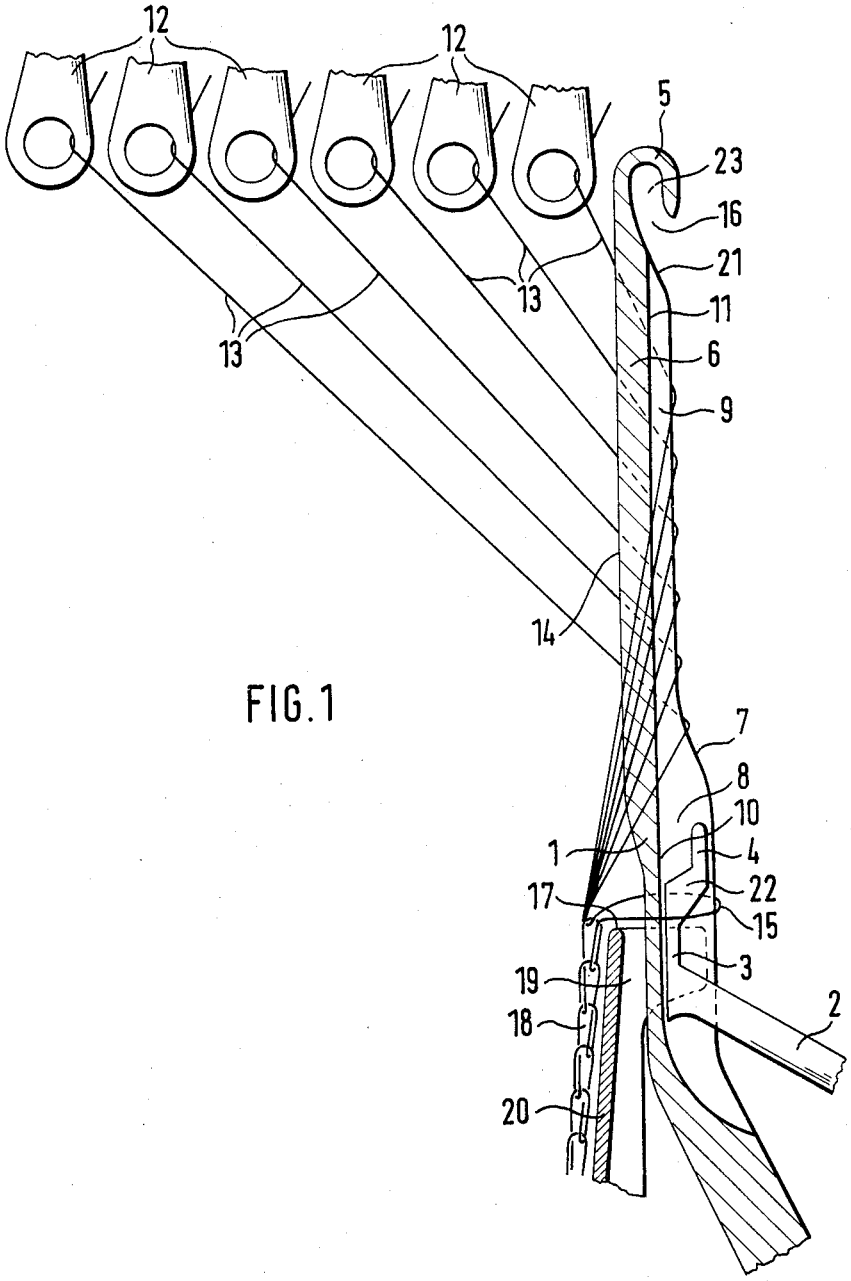
FIG. 1 shows a compound needle according to the invention in a position for laying the yarns.

Referring to FIG. 1, shown therein is a compound needle for a warp knitting machine having a needle stem 1, and a slide which comprises a slide arm 2, a middle section or guide portion 3 and a closure cover member 4. Disposed between the needle stem 1 and the hook 5 is a connecting portion 6 which extends towards the needle stem 1 as far as the inclined breast portion 7 of the needle stem 1. In the open position of the needle as illustrated in FIG. 1, the slide is disposed with its guide portion 3 and its closure member 4 completely concealed within the groove 8 which is provided in the breast portion of the needle stem and out of which only projects the actuating arm 2 of the slide.

The groove 8 is extended towards the hook 5 into a guide groove 9 formed in the connecting portion 6, and, as will be seen the bottom 10 of the groove 8 and the bottom 11 of the guide groove 9 are at the same level, although the guide groove 9 is of smaller depth than the groove 8.

The position of the needle shown in FIG. 1 is the so-called laying or open position in which the warp yarns 13 are laid over the compound needle in a known manner by means of the eye needles 12, in such a way that the yarns 13 lie in front of the breast portion 7. In the illustrated embodiment, there are six eye needles 12 and accordingly six warp yarns 13. The length of the connecting portion 6 shows however that a greater number of eye needles 12 and accordingly a larger number of warp yarns 13 could also readily be provided. The number of eye needles 12 and correspondingly the number of the warp yarns 13 is limited by the length of the connecting portion 6 insofar as, in the so-called underlap operation in which the warp yarns 13 are laid around the back 14 of the extension portion 6, it is necessary to ensure that the warp yarn which is disposed closest to the hook 5 cannot for example slip off over the hook 5. In the underlap operation, the warp yarn must still remain at a sufficient distance from the hook 5.

FIG. 1 also shows the loop 15 which is formed in a known manner and which, in the course of further knitting operation, is cast off over the hook 5 (for which purpose the opening 16 of the hook is closed in the manner described with reference to FIG. 5), thereby forming the knitted article 18 which is drawn over the stationary knocking-over edge 17. The edge 17 is a component of the knocking-over bar 20 from which the holder projections 19, which ensure that the loops 15 which are connected from needle to needle can be supported, project in a comb-like configuration into the spaces between the individual needle stems 1.

Figure 2:
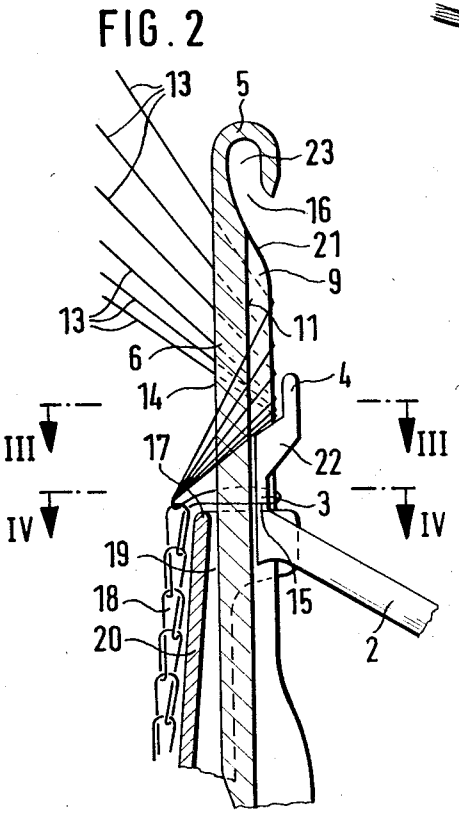
FIG. 2 shows the same compound needle approximately at the middle of the relative movement of the slide and the needle.

FIG. 2 shows the needle illustrated in FIG. 1 in an operating phase in which the needle, of which FIG. 2 shows only the connecting portion 6 and the hook 5, has advanced relative to the slide comprising the closure member 4, the guide portion 3 and the stem 2, to such an extent that the warp yarns 13 which are laid over the connecting portion 6 have approached the hook 5. With that relative movement which occurs by virtue of the needle stem 1 as shown in FIG. 1 and thus the extension portion 6 being retracted, the closure member 4 of the slide comes out of the channel or groove 8; when that happens, it projects out of the guide groove 9, extending over the warp yarns 13 which are laid over the connecting portion 6. However, the guide portion 3 of the slide remains in the guide groove 9 so that the slider is still guided relative to the needle stem 1 and the connecting portion 6. In each relative movement, the warp yarns 13 which are laid over the connecting portion 6 slide away in front of the step 22 which joins the closure member 4 and the guide portion 3, thereby ensuring that finally all yarns 13 slide in over the flattened portion 21 with which the connecting portion 6 terminates in the space 23 inside the hook.

Figure 5:
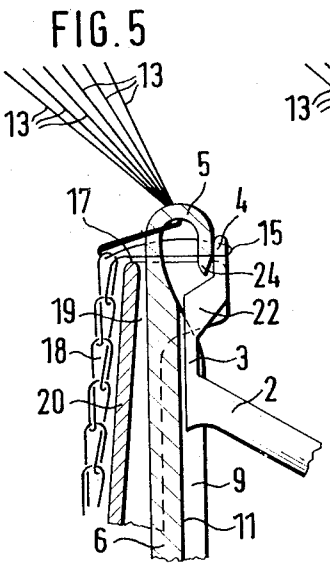
FIG. 5 shows the same compound needle in the closed position.

That operating position, being the closed position, is illustrated in FIG. 5. In that Figure, the closure member 4 covers over the end 24 of the hook so that the loop 15 can slide off over the hook 5. The loop 15 thus becomes part of the knitted article 18.

As can be seen, the slide comprising the components 2, 3, 22 and 4 is of relatively short construction. However, it is always guided, more particularly initially (see FIG. 1) by the groove 8 and subsequently (see FIGS. 2 and 5) by the guide groove 9. The guide action extends directly into the vicinity of the hook 5 so that the guide portion 3 of the slide can be of a correspondingly short construction. Accordingly, the groove 8 in the stem 1 of the needle is also correspondingly short.

Figure 4:
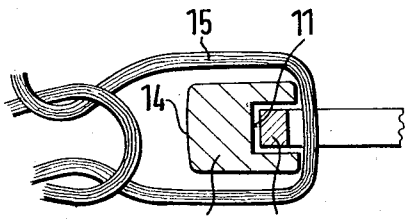
FIG. 4 shows a view in section taken along line IV—IV in FIG. 2.
Figure 3:
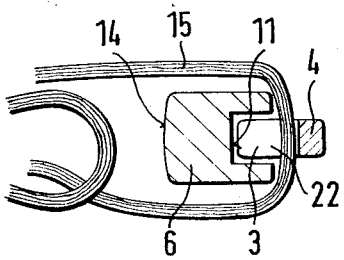
FIG. 3 shows a view in section taken along line III—III in FIG. 2.

In order to make clear the configuration of the connecting portion 6 and the slide comprising the components 2, 3, 22 and 4, FIGS. 3 and 4 show views in section from FIG. 2, FIG. 3 being a view in section taken along line III—III and FIG. 4 being a view in section taken along line IV—IV.

It should also be pointed out that, by virtue of the middle secion of guide portion 3 of the slide being concealed within the guide groove 9, there is also the effect that, when the loop 15 slides over the connecting portion 6, towards the hook 5, the loop is always carried by the connecting portion 6. That moreover is also made clear from the sectional view in FIG. 4. The slide comprising the components 2, 3, 22 and 4 is therefore not subjected to a loading by the loop 15 during the relative movement between the connecting portion 6 and the slide, so that the slide can be guided in a virtually friction-free manner by the guide groove 9.

Figure 6:
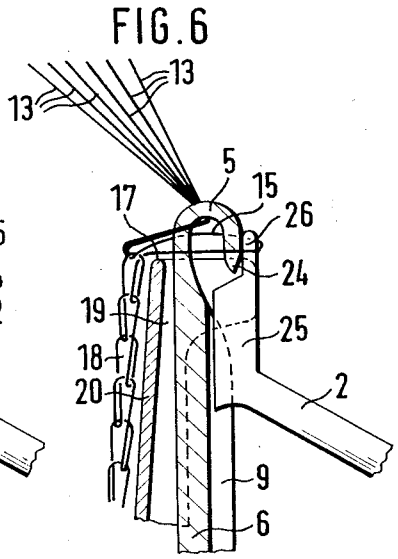
FIG. 6 shows a compound needle with a modified slide in the closed position.

FIG. 6 shows an alternative form of the embodiment illustrated in FIGS. 1–5, wherein the slide has a middle section or guide portion 25 which is not concealed within the guide groove 9. In this embodiment therefore, the guide portion 25 carries the loop 15 during the movement of the guide portion 25 along the connecting portion 6 until reaching the hook 5, which can be accepted when the slide is of a sufficiently strong construction. The arrangement shown in FIG. 6 shows a further modification which is that the closure member 26 is formed as an inclined portion which, in the closure position illustrated, adjoins the correspondingly shaped end 24 of the hook. By virtue of that mutual configuration, this arrangement also ensures that the end 24 of the hook is covered over by the closure member 26 so that the loop 15 can slide off unimpededly over the hook 5.

I claim:

1. A compound needle for a warp knitting machine comprising a needle stem (1) having a breast portion (7) at one end and a hook (5) at the other end, said hook (5) having an open portion thereon, a first groove (8) located in said breast portion (7) in substantially longitudinal alignment with said hook (5), sliding means (2,3,4 and 22) being reciprocated between a forward, closed position wherein the open portion of said hook (5) is covered and a rearward, open position wherein the open portion of said hook (5) is uncovered, a connecting portion (6) on said needle stem (1) intermediately disposed between said hook (5) and said breast portion (7), said connecting portion (6) and said breast portion (7) adapted to receive a plurality of yarns (13), a second groove (9) in said connecting portion (6) and forming an extension of the first groove (8) to accommodate said slide means during its reciprocated movement, said sliding means having an inclined member (22) collecting the plurality of yarns laid over said connecting portion (6) and said breast portion (7) for movement of the plurality of yarns into the open portion of said hook (5) before it is covered.

2. A compound needle as claimed in claim 1 wherein said sliding means includes a slide arm (2), a slide guide (3) extending between said slide arm (2) and said inclined member (22), and a closure member (4) extending from said inclined member (22) to cover the open portion of said hook (5), and wherein said slide guide (3) guides said sliding means during its reciprocated movement in said first groove (8) and second groove (9).

3. A compound needle as claimed in claim 2 wherein said slide guide (3) has a depth less than the depth of said second groove (9) whereby said slide guide (3) is recessed in said second groove (9) thereby avoiding transverse loading on said slide guide (3) by the plurality of yarns during its reciprocated movement.

* * * * *